US007757387B2

(12) United States Patent
Iai et al.

(10) Patent No.: US 7,757,387 B2
(45) Date of Patent: Jul. 20, 2010

(54) APPARATUS FOR CONTINUOUSLY MANUFACTURING FASTENER STRINGER

(75) Inventors: Kenichiro Iai, Toyama (JP); Koitsu Morioka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 1171 days.

(21) Appl. No.: 11/368,584

(22) Filed: Mar. 6, 2006

(65) Prior Publication Data

US 2006/0201217 A1 Sep. 14, 2006

(30) Foreign Application Priority Data

Mar. 9, 2005 (JP) ..... 2005-065397

(51) Int. Cl.
*A41H 37/06* (2006.01)
*B21D 53/54* (2006.01)
*B21D 39/20* (2006.01)

(52) U.S. Cl. ..... 29/769; 29/409; 72/58

(58) Field of Classification Search ..... 29/766, 29/767, 768, 769, 409, 410, 408, 706, 798, 29/432, 708, 33.2, 34 A, 33 B; 72/58, 338, 72/383.3; 192/134
See application file for complete search history.

(56) References Cited

U.S. PATENT DOCUMENTS 4,044,445 A * 8/1977 Douri ..... 29/706
4,550,477 A 11/1985 Iai
4,698,505 A * 10/1987 Brand ..... 250/337
5,671,510 A 9/1997 Maeda et al.
5,778,519 A * 7/1998 Maeda et al. ..... 29/769
5,926,934 A * 7/1999 Maeda et al. ..... 29/408
6,131,429 A * 10/2000 Ward ..... 72/1
7,246,422 B2 * 7/2007 Iai et al. ..... 29/33.2

FOREIGN PATENT DOCUMENTS

JP B2-59-51813 12/1984
JP A-8-56714 3/1996

* cited by examiner

*Primary Examiner*—John C Hong
(74) *Attorney, Agent, or Firm*—Alston & Bird, LLP

(57) ABSTRACT

A fastener stringer continuous manufacturing apparatus which eliminates a necessity of increasing a size of a manufacturing apparatus and is capable of chamfering attaching legs of an engaging element which is produced continuously from a metallic wire rod having a Y-shaped section, securely and accurately, without changing a load and stroke of a pressurizing hammer, the manufacturing apparatus comprises a pair of chamfering punches each of which is disposed above the pressurizing hammer at a height corresponding to a preceding engaging element implanted to a fastener tape in advance, the chamfering punch reciprocating with respect to a side face of the preceding engaging element and having a chamfering face which chamfers outer ridge portions of right and left legs of the preceding engaging element.

4 Claims, 8 Drawing Sheets

APPARATUS FOR CONTINUOUSLY MANUFACTURING FASTENER STRINGER

BACKGROUND OF THE INVENTION

1. Field of the Invention

The present invention relates to a method and apparatus for continuously manufacturing a fastener stringer in which a plurality of engaging elements are implanted at a predetermined interval on one side edge of a fastener tape.

2. Description of the Related Art

As disclosed in, for example, Japanese Patent Application Publication No. 59-51813, this kind of fastener stringer is usually obtained as follows. That is, a long metallic wire rod having a circular section is molded so as to have a substantially Y-like shape in its lateral section through a plurality of mill rolls and cut successively with a predetermined thickness by a cutting punch and a cutting die so as to obtain individual engaging elements. An engaging head is formed into a mountain-like shape by a forming punch and a forming die so as to obtain an engaging element comprising an engaging head and attaching legs (hereinafter referred to as a "wire rod engaging element"). Subsequently, the engaging elements are implanted successively to a fastener tape by pressurizing the attaching legs with a pressurizing hammer.

According to the method for continuously manufacturing the fastener stringer, the engaging elements are produced from one continuous engaging element metallic wire rod having a circular section and the engaging elements are implanted successively to the fastener tape, thereby making it possible to manufacture the fastener stringer securing an excellent productivity without any production loss. However, because the individual engaging elements are produced by cutting a long wire rod with a predetermined thickness by a cutting punch, burr is always generated on its cutting end, so that it is difficult to obtain a smooth curved surface.

To eliminate such an inconvenience, for example, the inventor has already proposed an engaging element forming method as disclosed in Japanese Patent Application Laid-Open No. 8-56714. In this engaging element forming method, a chamfering face for chamfering an outside ridge portion on a periphery of a leg is formed on a pressurizing face of a pressurizing hammer. Then, chamfering is carried out by rolling the ridge portion on an outer periphery from the leg of the engaging element to a part of the engaging head at the same time when the engaging element is pressurized with the pressurizing hammer.

In the meantime, in this kind of the fastener stringer continuous manufacturing apparatus, after a main ram equipped with a cutting die and a forming die retracts and a metallic wire rod is cut, the main ram continues to retract further, so that an engaging element cut by a cutting punch provided on the frame is pushed forward and automatically moved to a position for forming a head of the engaging element into a mountain-like shape by a forming punch. A pressurizing hammer supports attaching legs of the engaging element carried to the forming die from either side of the engaging element. Immediately thereafter, the forming punch descends so as to form the head of the engaging element into a mountain-like shape. After the forming into the mountain-like shape is ended, the main ram advances forward so as to move the engaging element on the forming die forward to a pressurizing position. At this time, the pressurizing hammer moves obliquely forward together and starts its pressurizing operation, so that a crotch portion between the attaching legs of the engaging element is pressed against the edge of an engaging element implantation portion of the fastener tape, and at the same time, the pressurization of the attaching legs is completed.

Substantially at the same time when the pressurizing hammer is actuated to pressurize the engaging element to the fastener tape, feeding of the fastener tape is started, and immediately thereafter, the main ram begins to retract again. The above-described motion of the pressurizing hammer aims at pressurizing the attaching legs of the engaging element gradually from the engaging head toward the leg tips and securing a required stroke length. Thus, the pressurizing hammer is formed in a parallelogram, and a pressurizing face at its inclined short side is introduced to a sliding groove of the pressurizing hammer which traverses obliquely a substantially half portion of an auxiliary ram by a pressing force of the actuating face of an actuating lever swung by a cam face formed on the side face of the auxiliary ram interlocking with the motion of the main ram. Consequently, the pressurizing hammer reciprocates linearly and obliquely forward over the substantially half portion of the ram. Here, an elastic force which presses the actuating face of the actuating lever is always applied to the pressurizing hammer. By using this elastic force, the pressurizing hammer is retracted quickly by the retracting action of the auxiliary ram and the elastic force regardless of its large stroke length, thereby avoiding an interference with the cutting punch securely.

However, if it is intended to chamfer at the same time when the attaching legs of the engaging element are pressurized with the pressurizing hammer as described in the above-mentioned Japanese Patent Application Laid-Open No. 8-56714, not only a chamfered portion becomes longer than a conventional stroke length but also a load on an operated pressurizing hammer increases by an amount corresponding to the chamfered portion. Thus, it is necessary to further sharpen an inclination angle of a front end of the pressurizing hammer and also to increase a swing angle of the actuating lever and further an inclination of the aforementioned cam. This unavoidably leads to an enhancement of the strength of the actuating lever and an increase in size of the apparatus.

SUMMARY OF THE INVENTION

The present invention has been achieved to solve such a problem, and an object of the invention is to provide a fastener stringer continuous manufacturing apparatus which eliminates the necessity of increasing the size of the apparatus and which can chamfer attaching legs of an engaging element securely and accurately without changing a load and stroke of a pressurizing hammer.

To achieve the above-described object, according to the invention, there is provided a fastener stringer continuous manufacturing method comprising: a cutting step of cutting a metallic wire rod for an engaging element, the metallic wire rod molded so as to have a substantially Y-shaped section, in a lateral direction with a predetermined thickness; a step of forming a head of the cut engaging element into a mountain-like shape; and an engaging element implantation step of successively implanting attaching legs of an engaging element which has been formed into the mountain-like shape to a fastener tape supplied intermittently at a predetermined pitch by pressurizing with a pressurizing hammer, the method further including: a chamfering step of chamfering an outer ridge portion of a preceding engaging element implanted to the fastener tape in the engaging element implantation step with a chamfering punch subsequent to the engaging element implantation step.

This manufacturing method can be executed effectively by using a fastener stringer continuous manufacturing apparatus of this invention having the following configuration.

That is, the fastener stringer continuous manufacturing apparatus of the invention comprises: a cutting die which reciprocates in a cutting direction of the metallic wire rod for the engaging element, the wire rod molded so as to have a substantially Y-shaped section; a forming die for forming a head of the engaging element into a mountain-like shape, the forming die provided continuously on a front end in a reciprocating direction of the cutting die; a cutting punch which is fixed to a base and disposed so as to freely make a sliding contact with an upper surface of the cutting die; a forming punch for forming the head of the engaging element into the mountain-like shape, the forming punch disposed above a mountain-like shape forming position and ascending and descending in cooperation with the forming die; and a pressurizing hammer for successively pressurizing attaching legs of the engaging element formed into the mountain-like shape to a fastener tape supplied intermittently at a predetermined pitch, the apparatus further including: a pair of chamfering punches, each of which is disposed above the pressurizing hammer at a height corresponding to a preceding engaging element implanted to the fastener tape in advance, the chamfering punch reciprocating with respect to a side face of the preceding engaging element and having a chamfering face which chamfers outer ridge portions of right and left legs of the preceding engaging element.

Preferably, the reciprocation of the chamfering punch is actuated in cooperation with a drive portion of the pressurizing hammer and such as actuation is carried out by an actuating lever specialized for the chamfering punch. More preferably, the actuating lever specialized for chamfering is swung by a cam face, which is formed in a same drive portion in a same manner as a pressurization actuating lever and is specialized for chamfering, and an actuating face of the actuating lever and a driven face of the chamfering punch have inclined faces that make a sliding contact with each other, and the respective inclined faces are so constructed that the chamfering punch entirely executes a composite motion composed of a reciprocating motion parallel to a swing direction of the actuating lever and a lateral motion in a direction perpendicular to the swing direction of the actuating lever. Additionally, the inclined driven face of the chamfering punch is always kept in an elastic contact with the inclined actuating face of the actuating lever under pressure, so that the driven face is reciprocated with sliding on the inclined actuating face of the actuating lever by a swing of the actuating lever.

If the feeding of a metallic wire rod is completed, a first ram advances, so that the metallic wire rod projects from a cutting die by an amount corresponding to a predetermined thickness. Here, the first ram begins to retract and a projecting portion of the wire rod is cut with a cutting punch, and an engaging element is moved from the cutting die to the forming die at a rear end stop position of the first ram. At this time, a top face ridge portion of an engaging head of the engaging element is preferred to be chamfered at the same time when the engaging element is cut out like conventionally. At this stage, pressurizing hammers are in a stopped condition and support legs of the engaging element from both sides in order to restrict a motion of the engaging element in a horizontal direction. Thereafter, a forming punch lowers at the rear end stop position of the first ram and a pressure pad also lowers so as to form the engaging head into a mountain-like shape.

When the first ram begins to advance, the pressurizing hammer is actuated to complete implantation of the engaging element. At the time of this pressurization, a chamfering punch is also actuated to chamfer the attaching legs of a preceding engaging element implanted to the fastener tape in advance of the pressurized engaging element. The chamfering with the chamfering punch is executed independently of the pressurization by the pressurizing hammer. Therefore, no higher load than necessary is applied to each of them and the stroke of the pressurizing hammer never prolongs more than that of a conventional example, thereby guaranteeing secure and smooth pressurization and chamfering processings.

In the engaging element implanted to the fastener tape, at least a ridge portion on an outside cutting edge of the attaching leg is curved, thereby manufacturing a fastener stringer formed into an outer shape having a smooth curved face. Thus, a completed slide fastener is provided with an excellent tactile feeling, and further, a sliding resistance of the slider decreases, thereby allowing the opening and closing operation of the slide fastener to be executed smoothly.

In the reciprocating the chamfering punch, the pressurization actuating lever for the pressurizing hammer, which is supported rotatably by the same shaft as a drive shaft of the pressurizing hammer, for example, supported by the same rotary shaft, and the chamfering actuating lever for the chamfering punch are actuated independently of each other by first and second cam faces which actuate in cooperation with each other with the main ram as a drive source. As a result, the pressurization to the legs of the engaging element and the chamfering on the outer ridge portion are executed by independent members. Consequently, a necessary stroke length can be secured without applying a higher load than necessary to pressurizing and chamfering processings, and the apparatus can withstand a long period operation. Further, in the case where the inclined face of the chamfering punch slides and moves on the inclined face of the actuating lever specialized for chamfering work, the actuating lever specialized for the chamfering work is swung in a transverse direction of the main ram by the cam face of the drive shaft and at the same time, the chamfering punch entirely advances with keeping its chamfering face obliquely with respect to an engaging element implanted to the fastener tape in the time before last time. When the chamfering is completed, the actuating lever is swung in an opposite direction and at the same time, the chamfering punch returns to its original standby position quickly. The return at this time is carried out by an elastic force of a spring or the like. Because at this time, the chamfering punch retracts while moving laterally to the standby position with its oblique state, interference with other surrounding members can be avoided.

DESCRIPTION OF THE PREFERRED EMBODIMENTS

Hereinafter, embodiments of the present invention will be described specifically with reference to the accompanying drawings.

Here, fastener stringer continuous manufacturing method and apparatus of the present invention are not different from the conventional method and apparatus disclosed in Japanese Patent Application Publication No. 59-51813 in that an engaging element wire rod having a substantially Y-shaped section obtained through a rolling process is cut to a thickness corresponding to a single engaging element with a cutting punch, its engaging head is formed into a mountain-like shape and then the engaging element is implanted to a required portion of a fastener tape by pressurizing attaching legs with a pressurizing hammer so as to manufacture a fastener stringer continuously.

The most prominent feature of the present invention is not that the attaching legs L of an engaging element are chamfered at the same time when the attaching legs L of the engaging element are pressurized with a pressurizing hammer having a chamfering face as disclosed in Japanese Patent Application Laid-Open No. 8-56714, but that a preceding engaging element, after pressurized to the fastener tape in advance and fed up to a predetermined position from the pressurizing portion by a predetermined pitch, is chamfered independently. Further, the chamfering of the preceding engaging element is carried out at the same time when the engaging element is pressurized by using the same drive shaft used for pressurizing process.

Because the process at the pressurizing portion and the process at the chamfering portion are carried out separately, the pressurization can be executed with the same stroke as a conventional pressurizing stroke without changing the stroke length of the pressurizing hammer. Further, because the chamfering is carried out with a special punch independently of the pressurizing, the chamfering can be carried out securely and accurately, so that the operation of each punch is performed extremely smoothly.

Figure 1:
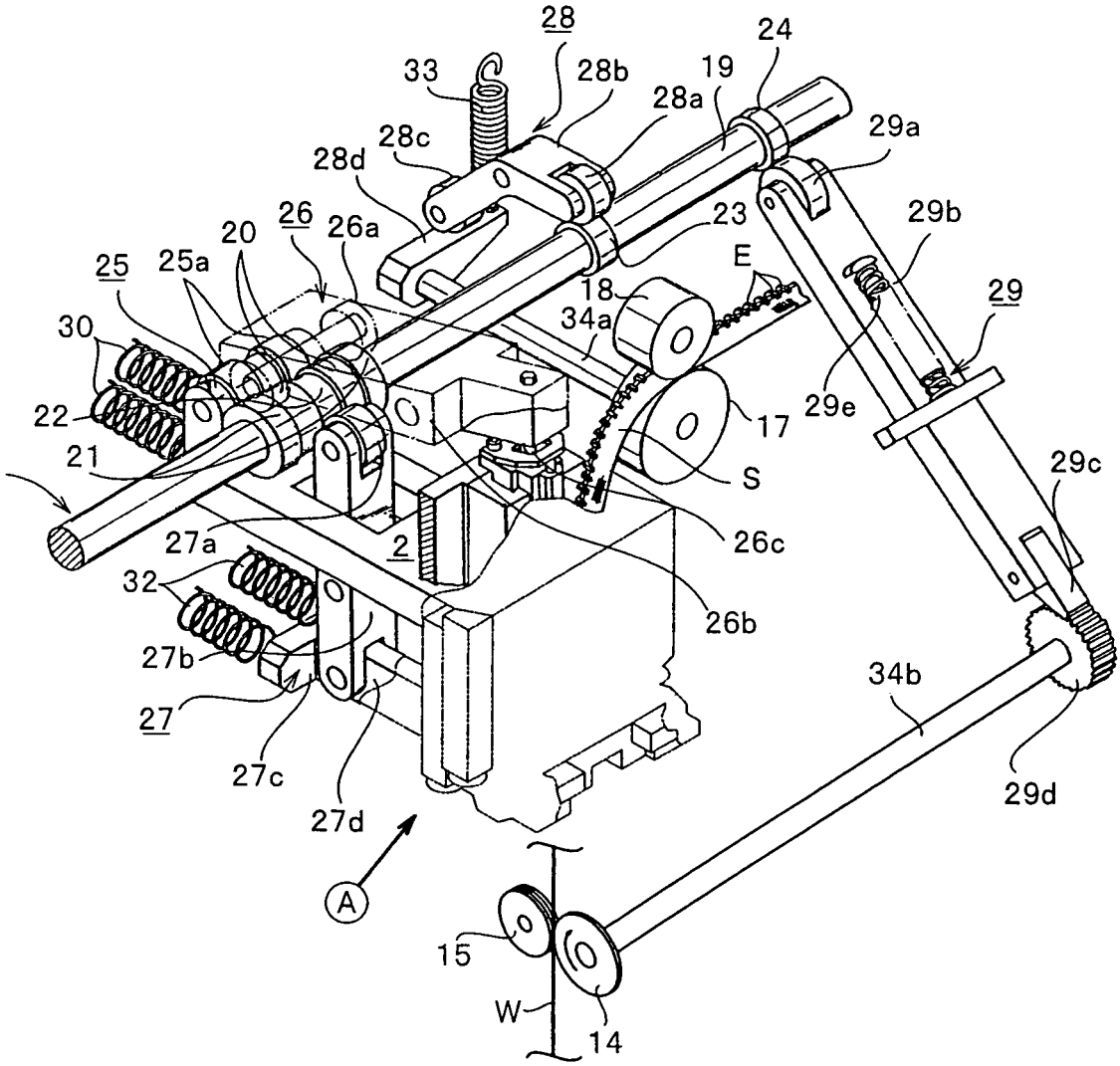
FIG. 1 is a perspective view schematically showing major portions of a fastener stringer continuous manufacturing apparatus to which the invention is applied.
Figure 2:
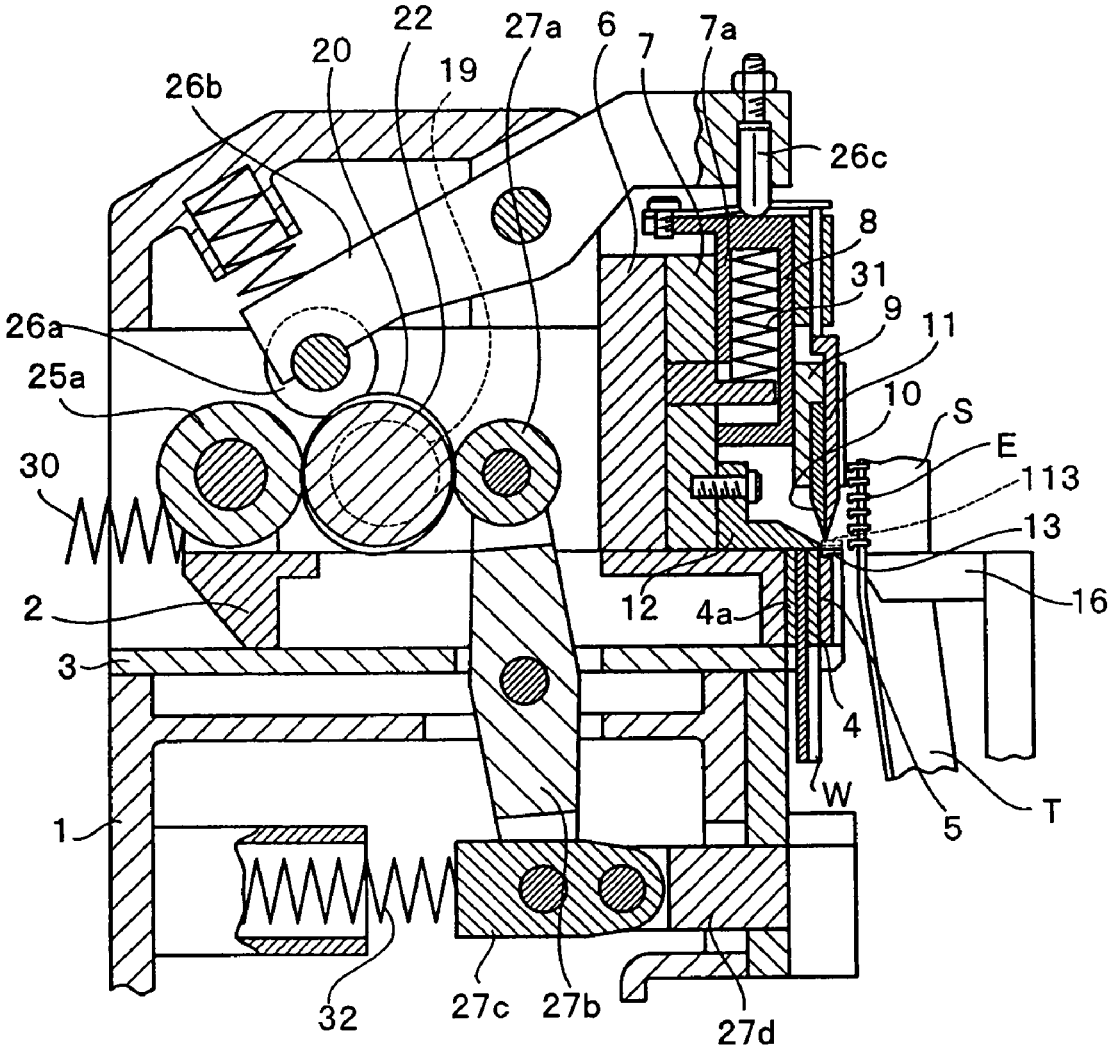
FIG. 2 is a longitudinal sectional view of an engaging element forming portion of the same apparatus.
Figure 3:
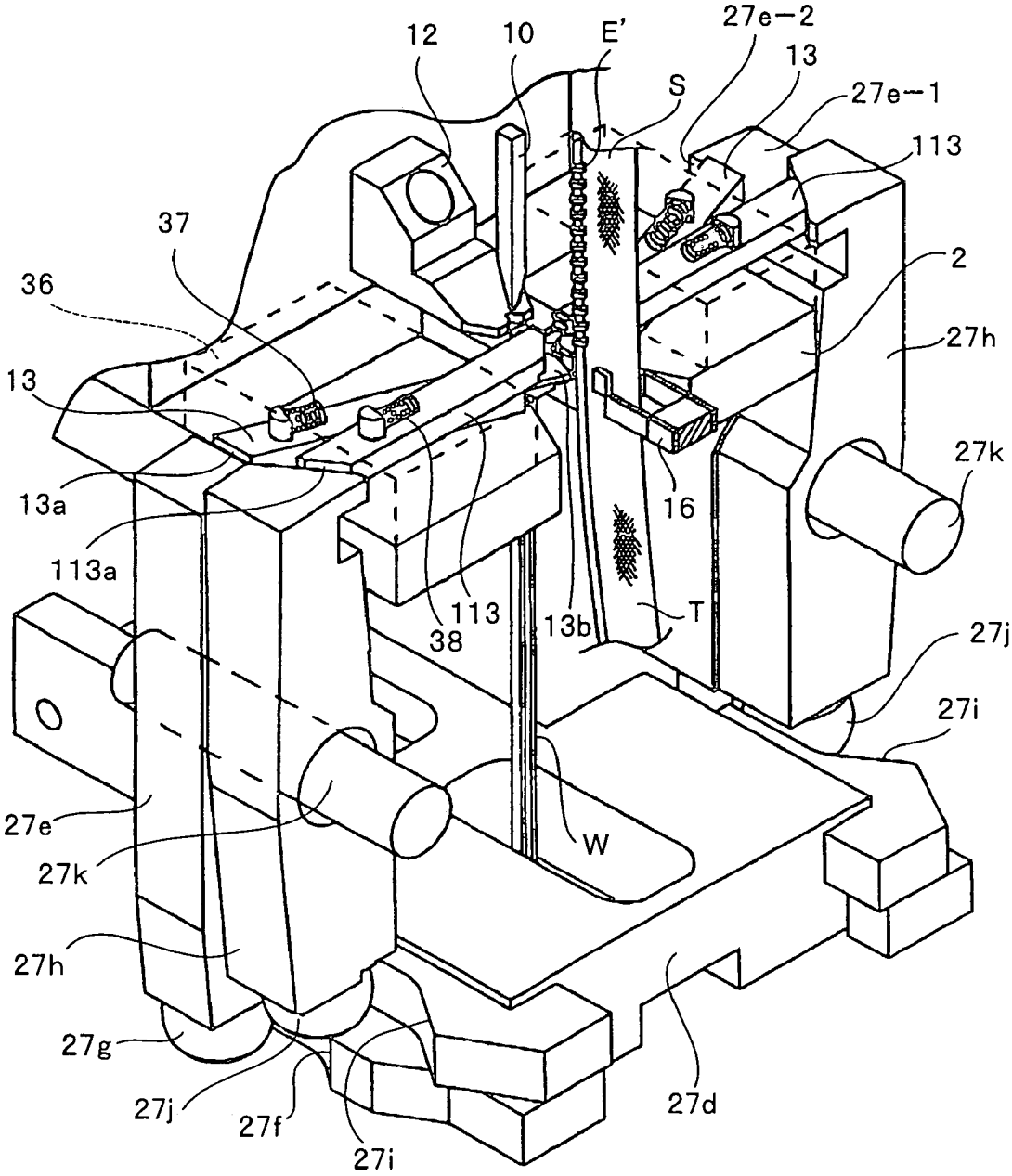
FIG. 3 is an enlarged perspective view showing specific configurations of a pressurizing portion and a chamfering portion indicated with an arrow A in FIG. 1.

FIGS. 1 and 2 schematically show an example of major portions of the fastener stringer manufacturing apparatus according to an embodiment of the invention. FIG. 3 is an enlarged perspective view of major portions of a specific configuration indicated with A in FIG. 1.

In the fastener stringer continuous manufacturing apparatus employed in this embodiment, the details of the configuration excluding the pressurizing portion and the chamfering portion are substantially not different from that of the apparatus disclosed in Japanese Patent Application Publication No. 59-51813. Thus, outline of other configuration except the pressurizing portion and the chamfering portion described below is based on description of the above-described publication.

In these figures, a first ram 2 is supported on a base 1 through a ram guide 3 so as to freely reciprocate horizontally, and a cutting die 4 and a forming die 5, the forming die forming an engaging head of an engaging element E into a mountain-like shape, are provided on the front end portion of the first ram 2 in this order in an advancement direction of the first ram 2. The cutting die 4 has an introduction passage 4*a* for introducing an engaging element irregular shape wire rod W having, for example, a Y-shaped lateral section.

A set plate 6 supported by the base 1 is disposed above the front portion of the first ram 2, and a ram guide 7 is mounted on the set plate 6. A second ram 8 is provided on the ram guide 7 so as to be capable of moving up and down vertically with respect to the horizontal reciprocation movement of the first ram 2. A forming punch 10 for forming the engaging head of the engaging element E into a mountain-like shape through a punch holder 9 and a pressure pad 11 for pressing both legs L of the engaging element E at the time of forming into the mountain-like shape are mounted on the front face of the second ram 8. Further, a cutting punch 12 capable of making a sliding contact with the top face of the front portion of the first ram 2 is fixed on the bottom end of the ram guide 7. A pair of pressurizing hammers 13 are provided obliquely on both sides of the forming die 5, and the pressurizing hammers 13 move linearly so as to nip and pressurize the attaching legs L of the engaging element E after the engaging head is formed, thereby implanting the engaging element E to a fastener tape T. In this indicated example, at the same time when the engaging element E is pressurized, the chamfering punches 113 are actuated so as to chamfer outer ridge portions of right and left legs L' of a preceding engaging element E' implanted to the fastener tape T two times before.

As shown in FIG. 1, the wire rod W for the engaging element having a Y-shaped section is intermittently supplied by an amount corresponding to the thickness of a single engaging element E by feed rollers 14, 15 to the wire rod insertion hole 4*a* in the cutting die 4. The fastener tape T is supplied from below and guided by a tape guide 16 and the engaging elements E are attached to the fastener tape, and then the fastener tape T becomes a slide fastener stringer S. The slide fastener stringer S is intermittently pulled up by an intermittent drive roller 17 and a pressure roller 18.

A main shaft 19 is provided above the rear portion of the first ram 2, and a first ram drive cam 20, a forming punch actuating cam 21, a pressurizing/chamfering actuating cam 22, a stringer feeding cam 23 and a wire rod feeding cam 24 are provided on the main shaft 19. The respective cams 20 to 24 are respectively connected to the first ram 2, the forming punch 10, the pressurizing hammer 13 and a chamfering punch 113, the intermittent drive roller 17 and the wire rod feed roller 14 via cam driven mechanisms 25 to 28, and the respective members are actuated.

The cam driven mechanism 25 of the first ram 2 has a first roller 25*a* which makes a rolling contact with the first ram drive cam 20, and the roller 25*a* is journaled by the rear portion of the first ram 2. The first ram 2 is urged in an advancement direction by a compression spring 30, and is horizontally reciprocated by a rotation of the first ram drive cam 20. Further, the cam face of the first ram drive cam 20 is so constructed as to stop the first ram 2 in a predetermined time at its front end position and rear end position.

On the other hand, the cam driven mechanism 26 of the forming punch 10 comprises a second roller 26*a*, a lever 26*b*, a pin 26*c*, and a compression spring 26*d*. The second roller 26*a* makes a rolling contact with the forming punch actuating cam 21. The roller 26*a* is journaled by one end of the lever 26*b*, and a central portion of the lever 26*b* is mounted on the apparatus main body via a shaft. The pin 26*c* is attached to the other end of the lever 26*b*, and makes contact with the head of the second ram 8. The compression spring 26*d* gives the lever 26*b* back. The second ram 8 incorporates a compression spring 31 for urging the ram upward, and the lever 26*b* swings by the cam 21, so that the second ram 8 lowers and this returns to its original position by the compression spring 31.

The cam driven mechanism 27 of the pressurizing hammer 13 and the chamfering punch 113 comprises, as shown in FIGS. 1 and 2, a third roller 27*a*, a swing lever 27*b*, a link 27*c*, a third ram 27*d*, a pressurization actuating lever 27*e*, and a chamfering actuating lever 27*h*. The third roller 27*a* makes a rolling contact with the pressurizing/chamfering actuating cam 22. The swing lever 27*b* supports the roller 27*a* through a shaft at its upper end, extends downward and swings back and forth with a central portion thereof journaled by the base 1. A central portion of the link 27*c* is connected to the bottom end of the swing lever 27*b* through a shaft. The front end of the link 27*c* is connected to the rear portion of the third ram 27*d* through a shaft. A driven face of the pressurizing hammer 13 makes a contact with the actuating face of the top portion of the pressurization actuating lever 27*e*, and a central portion of the pressurization actuating lever 27*e* is journaled. A driven face of the chamfering punch 113 makes contact with the actuating face of the top portion of the chamfering actuating lever 27*h*, and a central portion of the chamfering actuating lever 27*h* is journaled.

As shown in FIG. 3, a first cam face 27*f* and a second cam face 27*i*, which are two stages vertically separated, are provided on the right and left side faces of the front end portion of the third ram 27*d* such that they are deflected by a required dimension in the back and forth direction. The first and second cam faces 27*f*, 27*i* have a shape extending outward as they go to the front ends, respectively. A first cam receiver 27*g* mounted on the bottom end of the pressurization actuating lever 27*e* makes an elastic contact with the first cam face 27*f* while a second cam receiver 27*j* provided on the bottom end of the chamfering actuating lever 27*h* makes an elastic contact with the second cam face 27*i*. As the third ram 27*d* retracts, the first and second cam receivers 27*g*, 27*j* move in the right and left direction along the first and second cam faces 27*f*, 27*i*, so that the first and chamfering actuating levers 27*e*, 27*h* swing. When the first and chamfering actuating levers 27*e*, 27*h* swing, the pressurizing hammer 13 and the chamfering punch 113 are actuated. Restoration of the third ram 27*d* to its original position is carried out by the compression spring 32, and also, return operations of the first and second actuating levers 27*e*, 27*h* and the pressurizing hammer 13 and the chamfering punch 113 are carried out by a spring.

As shown in FIG. 1, the cam driven mechanism 28 for feeding a stringer comprises a fourth roller 28*a*, a first lever 28*b* and a second lever 28*d*. The fourth roller 28*a* makes a rolling contact with the stringer feeding cam 23. The roller 28*a* is journaled by one end of the first lever 28*b* and a fifth roller 28*c* is journaled by the other end thereof, and a central portion of the first lever 28*b* is supported via a shaft. The second lever 28*d* swings downward by a sixth roller 28*e* and is urged upward by a pulling spring 33. A transmission shaft 34*a* of the intermittent drive roller 17, in which a single-direction clutch (not shown) is mounted on an intermediate portion thereof, is connected to a proximal end of the second lever 28*d*, so that the intermittent drive roller 17 is intermittently rotated only in a single direction so as to feed the fastener stringer S.

Figure 4:
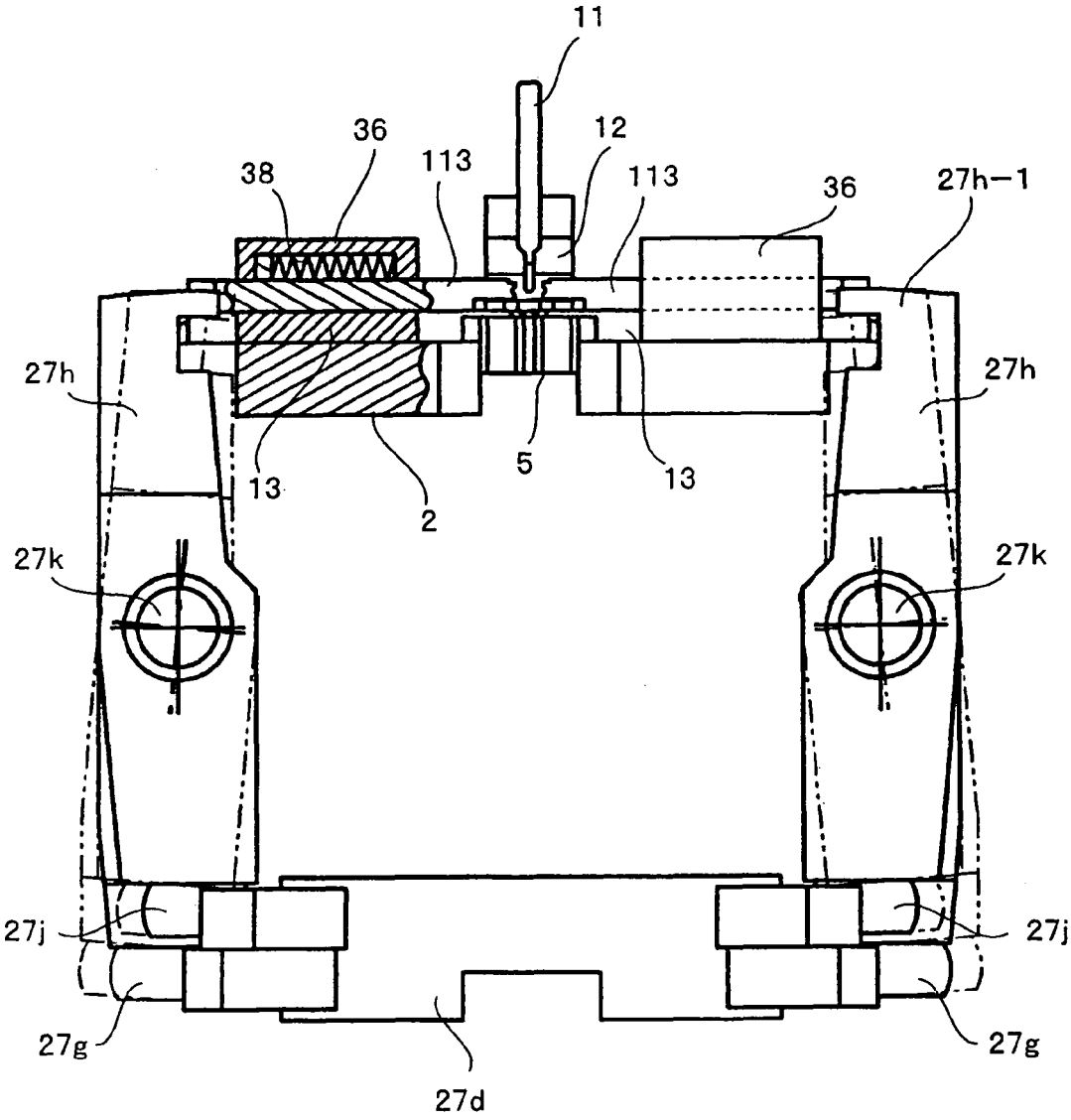
FIG. 4 is a front view of the pressurizing portion and the chamfering portion.

The cam driven mechanism 29 for feeding a wire rod comprises: a sixth roller 29*a* which makes a rolling contact with the cam 24; a slider 29*b* having the roller 29*a* supported via a shaft at one end of the slider; a ratchet 29*c* attached to the other end of the slider 29*b*; and a ratchet wheel 29*d* which is intermittently rotated only in a single direction every predetermined angle by the ratchet 29*c*. A drive gear 42 for feeding a wire rod shown in FIG. 4 is attached to the other end of a supporting shaft 34*b* of the ratchet wheel 29*d*. The irregular shape metallic wire rod W is intermittently supplied through the drive roller 14 and the rolling roller 15 by an intermittent rotation of the drive gear 42. Restoration of the slider 29*b* to its original position is carried out by a compression spring 29*e*.

When the advancement of the first ram 2 stops, feeding of the irregular shape metallic wire rod W is completed, so that the irregular shape metallic wire rod W is projected over the cutting die 4 only by a predetermined thickness. In a former half of this process, the implantation of the engaging element E to the fastener tape T is completed. The fastener stringer S is pulled up immediately after pairs of the pressurizing hammers 13 and the chamfering punches 113 leave the legs L of the respective engaging elements E, E', and when the engaging head of the engaging element E leaves the forming die 5, the first ram 2 begins to retract. Thus, the currently implanted engaging element E is never caught by the forming die 5 which is retracted by the first ram 2.

When the first ram 2 retracts, the wire rod W is cut. At the time of this retraction, pulling of the fastener stringer S is completed. When the first ram 2 is located at its retraction stop position, the engaging head is formed. After implantation of the engaging element is started by the pressurizing hammer 13 actuated from halfway of the advancement of the first ram 2, the first ram 2 advances up to its advancement end position so as to complete pressurization. Before the pressurizing hammer 13 is actuated, the chamfering punch 113 is actuated, and at the same time when the pressurizing hammer 13 implants the engaging element E, the outer ridge portions on the legs L' of the preceding engaging element E' implanted time before last to the fastener tape T is chamfered. Hereinafter, such a procedure is repeated.

Next, an example of the structure of the pressurizing portion and chamfering portion which constitute the characteristic portion of the present invention will be described with reference to FIGS. 3 and 4. FIG. 4 is a partially broken front view of the pressurizing portion and chamfering portion. As shown in FIGS. 3 and 4 and described previously, the pair of pressurizing hammers 13 are provided on both sides of the forming die 5, so that the pair of right and left attaching legs L of the engaging element E having its engaging head formed thereon are nipped and pressurized from the right and left sides so as to implant the engaging element E to the fastener tape T. In the indicated example, at the same time when the engaging element E is pressurized, the chamfering punches 113 are actuated so as to chamfer the outer ridge portions of the right and left legs L' of the preceding engaging element E' implanted to the fastener tape T two times before.

Figure 10A:
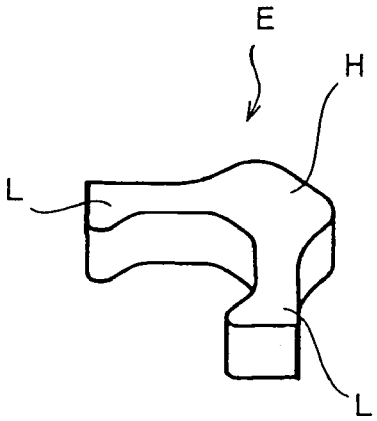
FIGS. 10A to 10C are explanatory views showing an example of an engaging element before pressurizing, an engaging element after pressurizing, and an engaging element after chamfering, respectively.
Figure 10B:
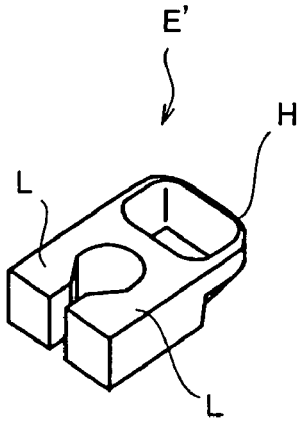

The pressurization actuating lever 27*e* is supported rotatably by a fixed supporting shaft 27*k*, and an actuating portion 27*e*-1 extending longer than the top face of the first ram 2 is provided at a top end of the actuating lever 27*e*. A front end face of the actuating portion 27*e* serves as an actuating face 27*e*-2 which is composed of a vertical plane extending along the back and forth direction of the first ram 2. The pressurizing hammer 13 is constituted of a narrow lever material having a substantially parallelogrammatic shape. The lever material brings a driven face 13*a* corresponding to the actuating face 27*e*-2 into an elastic contact with the actuating face 27*e*-2 of the pressurization actuating lever 27*e* and extends obliquely forward so as to reciprocate linearly toward the engaging element E intended to be pressurized over the top face of the first ram 2. An end of the pressurizing hammer 13 opposite to the inclined driven face 13*a* is formed into a thin plate via a step, and the rear end corner of each thin plate portion is cut out partially so as to form a leg nipping portion 13*b*. Each of the leg nipping portions 13*b* has a nipping face 13*c* for deforming the outer ridge portion of each of the pair of right and left attaching legs L into a shape shown in FIG. 10B by pressurizing the engaging element E formed into a Y shape shown in FIG. 10A. The front end actuating face 27*e*-2 of the actuating lever 27*e* is perpendicular to its swing direction, and the inclined driven face 13*a* is always kept in an elastic contact with the front end actuating face 27*e*-2 of the actuating portion 27*e*-1 by a spring force of a first spring 37 described later.

The pressurizing hammer 13 is actuated by swing of the pressurization actuating lever 27*e* and reciprocates obliquely on the top face of the first ram 2. When the attaching legs of the engaging element E is pressurized, it can be pressurized gradually from the engaging head of the engaging element E toward the front ends of the legs by disposing the pressurizing hammers 13 obliquely in this way. That is, when the engaging element E is formed into the mountain-like shape with the forming punch 8 at the forward end stop position of the first ram 2, the pressurizing hammers 13 advance slightly so as to hold a part of the outer side faces of the attaching legs L of the engaging element E by a pair of right and left leg nipping portions 13*b*, and after the forming into the mountain-like shape is ended, the hammers 13 further advance to complete the pressurization. At the same time when the pressurization is ended, the pressurizing hammers 13 begin to retract quickly by a spring force together with retraction of the pressurization actuating lever 27*e*.

The chamfering actuating levers 27*h* for actuating the pair of right and left chamfering punches 113 are supported rotatably at a position adjacent to the front side of the pressurization actuating lever 27*e* by the same fixed supporting shaft 27*k* as the pressurizing hammer 13. An actuating portion 27*h*-1 is formed at the top end of the chamfering actuating lever 27*h*. An oblique face of the actuating portion 27*h*-1 as viewed from top is constituted of a right triangle portion placed on a straight line connecting with the preceding engaging element E' implanted to the fastener tape T two times before. The position of its actuating face 27*h*-2 is set higher by an amount corresponding to two engaging elements E than the height of the actuating portion 27*e*-1 of the pressurization actuating lever 27*e*.

Figure 5:
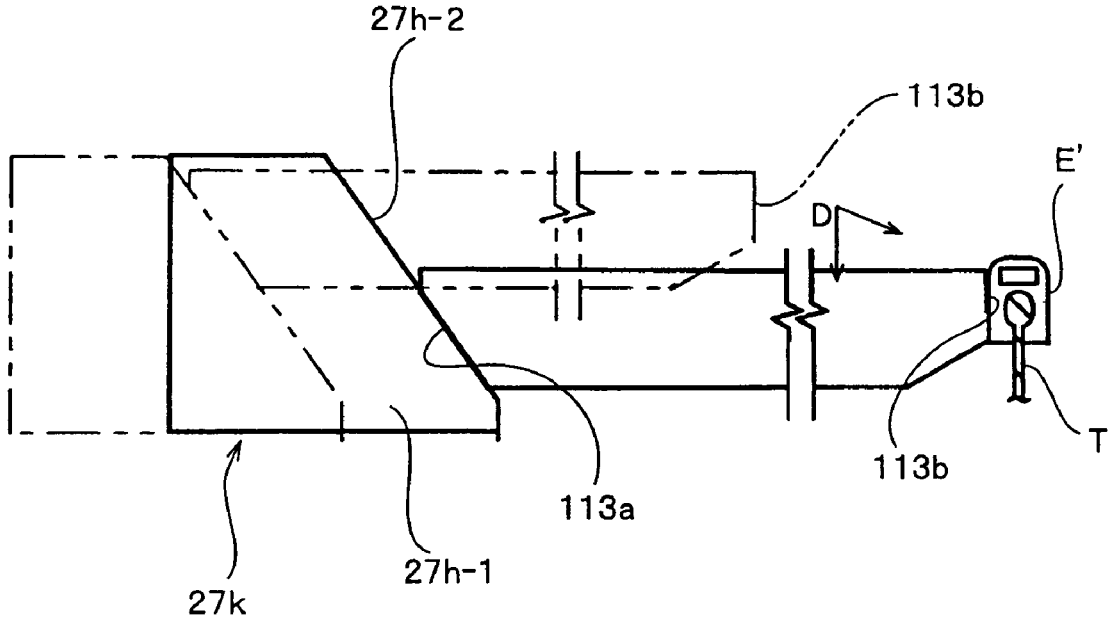
FIG. 5 is an explanatory diagram of an operation of a chamfering punch.
Figure 8:
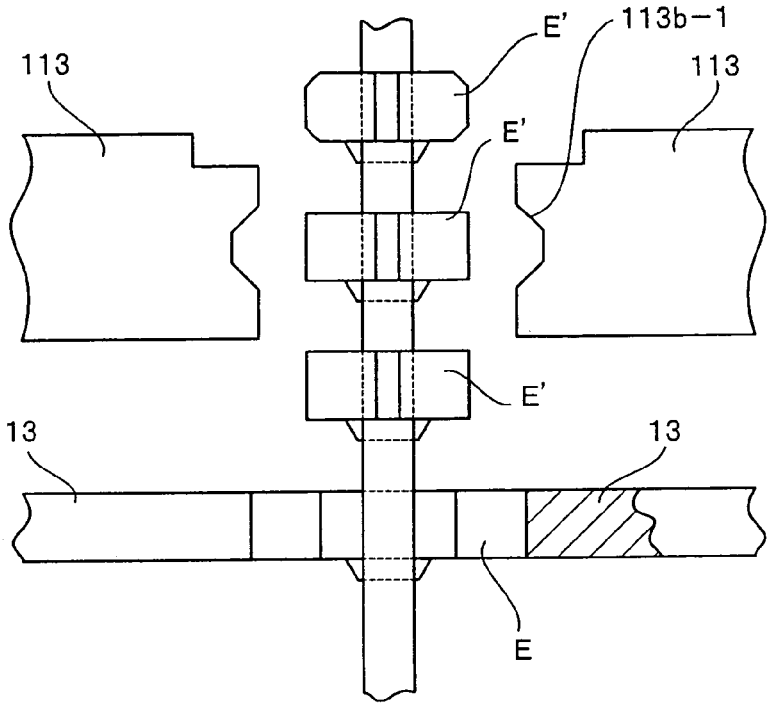
FIG. 8 is a partially broken front view showing the positional relation among a fastener stringer, the pressurizing hammer and the chamfering punch in a situation shown in FIG. 6.

On the other hand, as shown in FIG. 5, the chamfering punch 113 is constituted of an entirely narrow trapezoidal lever material, and an oblique portion at an end thereof constitutes an inclined driven face 113*a* which slides with a contact with the inclined actuating face 27*h*-2 of the chamfering actuating lever 27*h*. Further, the front end sharp angle portion at the other end of the chamfering punch 113 is cut out partially in parallel to the side face of the attaching leg L of the preceding engaging element E', and as shown in FIG. 8, a face opposing the preceding engaging element E' has a concave groove having a trapezoidal section in the center thereof as viewed from the side. The inside face of the concave groove constitutes a chamfering face 113*b* which is an important factor of the present invention. An inclined face 113*b*-1 of the chamfering face 113*b* is set longer than the length of the outer ridge portion of the attaching leg L' of the preceding engaging element E' and higher than the height of the preceding engaging element E'.

As shown in FIGS. 4 and 8, the formation position of the actuating portion 27*h*-1 of the chamfering actuating lever 27*h* is set higher than the height of the actuating portion 27*e*-1 of the pressurization actuating lever 27*e* and at the same height as a stop position of the preceding engaging element E' implanted to the fastener tape T two times before. As shown in FIG. 5, the actuating face 27*h*-2 at the front end of the actuating portion 27*h*-1 is inclined toward a chamfering portion of the preceding engaging element E'. As shown in FIG. 3, the chamfering punch 113 moves intersecting the pressurizing hammer 13 over the pressurizing hammer 13. As for the chamfering punch 113 at this time, as shown with an arrow in FIG. 5, the chamfering face 113*b* of the chamfering punch 113 moves obliquely forward along the inclined actuating face 27*e*-2 of the chamfering actuating lever 27*h* which swings laterally to the first ram 2, and the entire chamber punch 113 moves to the preceding engaging element E'. Then, the chamfering face 113*b* moves obliquely forward to the preceding engaging element E' and when it completes the chamfering, it returns to its original position without changing the posture.

According to this embodiment, the actuating faces of the pressurizing hammer 13 and the chamfering punch 113 are separated vertically, and further, the pressurizing hammer 13 slides on the top face of the first ram 2 while the chamfering punch 113 moves intersecting with the pressurizing hammer 113 over the same pressuring hammer 113. Consequently, the trajectories of the pressurizing hammer 13 and the chamfering punch 113 are not determined easily. Thus, according to this embodiment, to secure the trajectory of each of the pressurizing hammer 13 and the chamfering punch 113, the pressuring hammer 13 and the chamfering punch 113 are accommodated in a single housing 36. A hammer guide passage (not shown) for the pressurizing hammer 13 which extends linearly and obliquely to the engaging element E set in the forming die 5 is formed to go through the inside of the housing 36. In addition, a punch guide passage (not shown) for guiding the chamfering punch 113 is formed to go through a partition above the hammer guide passage. The chamfering punch 13 traverses the first ram 2 at right angle to the back and forth direction and has an appropriate width from its starting position to its chamfering position.

A first spring 37 is interposed between the hammer guide passage and the pressurizing hammer 13, and a second spring 38 is interposed between the punch guide passage and the chamfering punch 113. The pressurizing hammer 13 and the chamfering punch 113 are actuated securely at a required timing following up swings of the pressurization actuating lever 27*e* and the chamfering actuating lever 27*h* with elastic forces of the first and second springs 37, 38. A swing interval of the first and chamfering actuating lever 27*e*, 27*h* can be converted to a large stroke by moving the leg nipping face 13*b* of the pressurizing hammer 13 and the chamfering face 113*b* of the chamfering punch 113 obliquely, so that an interference with such a peripheral member as the cutting punch 12 can be avoided.

Figure 6:
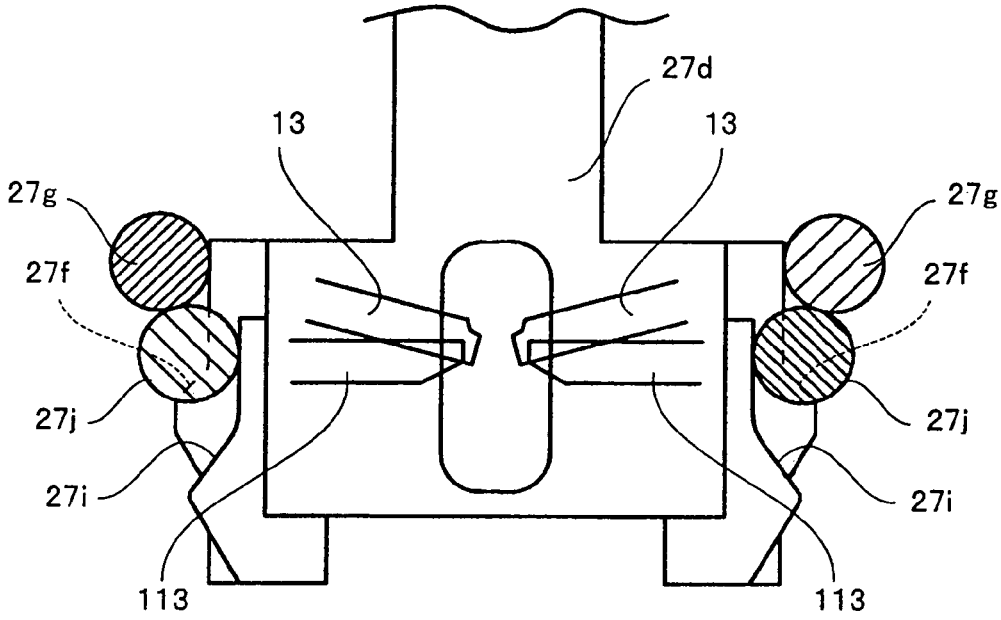
FIG. 6 is a plan view of major portions indicating rear end stop positions of a pressurizing hammer and the chamfering punch when a third ram is located at its retraction end stop position.
Figure 9:
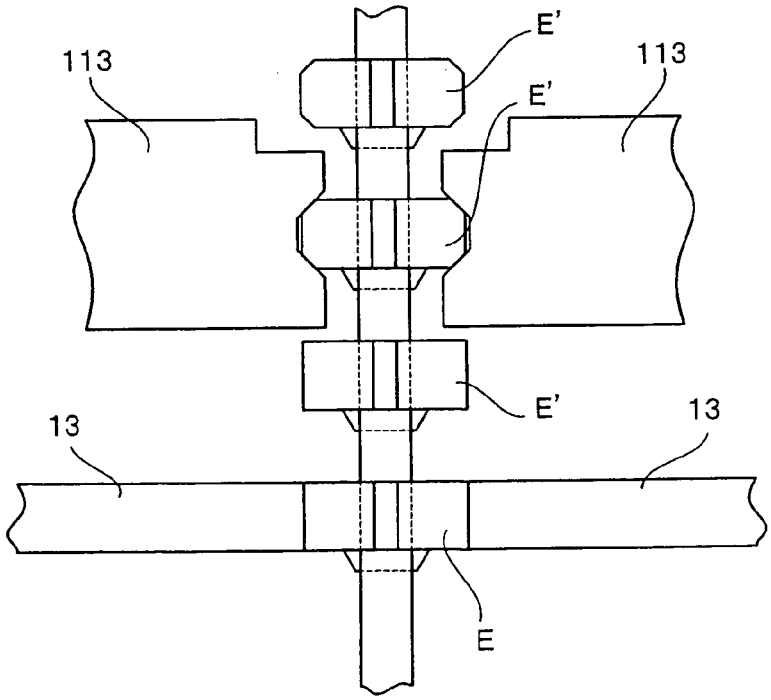
FIG. 9 is a partially broken front view showing the positional relation among the fastener stringer, the pressurizing hammer and the chamfering punch in a situation shown in FIG. 7.

The operation of the pressurizing portion and chamfering portion having the above-described configuration will be described specifically with reference to FIGS. 6 to 9. When the third ram 27*d* is located at its retraction stop position as shown in FIGS. 6 and 8, the first and second cam receivers 27*g*, 27*j* attached to the bottom end of the first and chamfering actuating levers 27*e*, 27*h* are in elastic contact with flat portions of the first and second cam faces 27*f*, 27*i*, and the pressurizing hammer 13 and the chamfering punch 113 are at a position where they are retracted most (standby position). If the third ram 27*d* begins to advance, the first cam receiver 27*g* first rides over the first cam face 27*f* so as to swing the pressurization actuating lever 27*e*. Consequently, its actuating face 27*e*-2 begins to advance in a direction of traversing the top face of the first ram 2, so that the pressurizing hammer 13 begins to move obliquely toward an engaging element E intended to be pressurized this time. A little before the pressurizing hammer 13 moves, the formation into the mountain-like shape with the forming punch 10 is carried out. Finally, as shown in FIG. 9, the leg nipping faces 13*b* pressurize and deform the right and left attaching legs L of the engaging element E and implant the engaging element E to a predetermined position of the fastener tape T.

Figure 7:
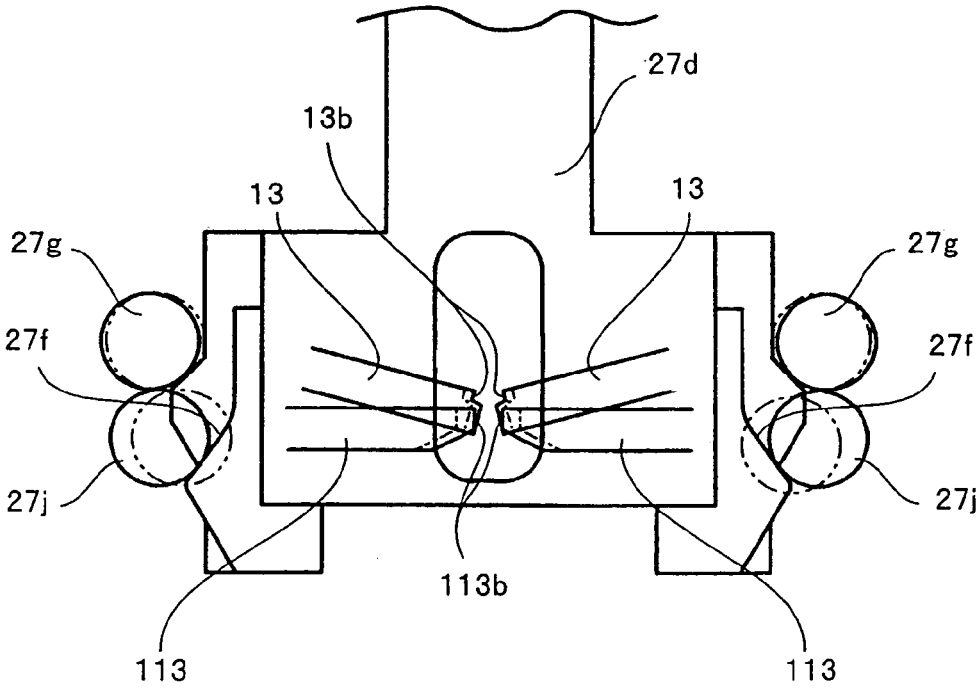
FIG. 7 is a plan view of major portions indicating advance end operation positions of the pressurizing hammer and the chamfering punch when the third ram is located at its advance end stop position.
Figure 10C:
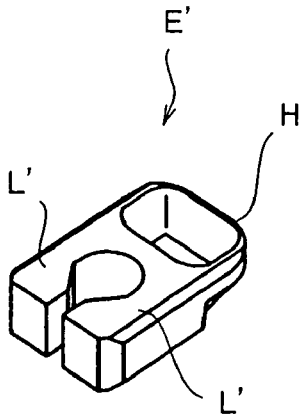

On the other hand, a little before the first cam receiver 27*g* rides over the second cam face 27*f*, the second cam receiver 27*j* begins to ride over the second cam receiver 27*i* with a slight difference of time so as to swing the chamfering actuating lever 27*h*. With this swing, the inclined drive face 113*a* of the chamfering punch 113 which makes an elastic contact with the inclined actuating face 27*h*-2 of the chamfering actuating lever 27*h* slides along the inclined actuating face 27*h*-2, so that the chamfering face 113*b* moves obliquely toward the preceding engaging element E' implanted to the fastener tape T two times before. Consequently, as shown in FIGS. 7 and 9, the inclined face 113*b*-1 presses the upper and lower outer ridge portions of the right and left attaching legs L' extending from the same engaging element E' so as to chamfer the upper and lower outer ridge portions at the same time as shown in FIG. 10C.

What is claimed is:

1. A fastener stringer continuous manufacturing apparatus comprising:

a cutting die which reciprocates in a cutting direction of a metallic wire rod for an engaging element, the metallic wire rod molded so as to have a substantially Y-shaped section;

a forming die for forming a head of the engaging element into a mountain-like shape, the forming die provided continuously on a front end in a reciprocating direction of the cutting die;

a cutting punch which is fixed to a base and disposed so as to freely make a sliding contact with an upper surface of the cutting die;

a forming punch for forming the head of the engaging element into the mountain-like shape, the forming punch disposed above a mountain-like shape forming position and ascending and descending in cooperation with the forming die;

a pressurizing hammer for successively pressurizing attaching legs of the engaging element formed into the mountain-like shape to a fastener tape supplied intermittently at a predetermined pitch, characterized by further including; and a pair of chamfering punches, each of which is disposed above the pressurizing hammer at a height corresponding to a preceding engaging element implanted to the fastener tape in advance, the chamfering punch reciprocating with respect to a side face of the preceding engaging element and having a chamfering face which chamfers outer ridge portions of right and left legs of the preceding engaging element.

2. The fastener stringer continuous manufacturing apparatus according to claim 1, wherein a reciprocation of the chamfering punch is actuated in cooperation with a drive portion of the pressurizing hammer and such an actuation is carried out by an actuating lever specialized for the chamfering punch.

3. The faster stringer continuous manufacturing apparatus according to claim 1, wherein an actuating lever specialized for chamfering is swung by a cam face, which is formed in a same drive portion in a same manner as a pressurization actuating lever and is specialized for chamfering, an actuating face of the actuating lever and a driven face of the chamfering punch have inclined faces that make sliding contact with each other, and the respective inclined faces are so constructed that the chamfering punch entirely executes a composite motion composed of a motion parallel to a swing direction of the actuating lever and a lateral motion in a direction perpendicular to the swing direction of the actuating lever.

4. The fastener stringer continuous manufacturing apparatus according to claim 1, wherein an inclined driven face of the chamfering punch is always kept in an elastic contact with an inclined actuating face of an actuating lever under pressure, so that it is reciprocated with sliding on the inclined actuating face of the actuating lever by a swing of the actuating lever.

* * * * *

UNITED STATES PATENT AND TRADEMARK OFFICE

CERTIFICATE OF CORRECTION

PATENT NO. : 7,757,387 B2
APPLICATION NO. : 11/368584
DATED : July 20, 2010
INVENTOR(S) : Iai et al.

It is certified that error appears in the above-identified patent and that said Letters Patent is hereby corrected as shown below:

Title Page

"(54) APPARATUS FOR CONTINUOUSLY MANUFACTURING FASTENER STRINGER"

should read

--(54) METHOD AND APPARATUS FOR CONTINUOUSLY MANUFACTURING FASTENER STRINGER--

Column 1

Line 1, "Apparatus for Continuously" should read --Method and Apparatus for Continuously--

Signed and Sealed this
Fourth Day of January, 2011

David J. Kappos

David J. Kappos
*Director of the United States Patent and Trademark Office*